US007832247B2

(12) United States Patent
Cho et al.

(10) Patent No.: US 7,832,247 B2
(45) Date of Patent: Nov. 16, 2010

(54) APPARATUS AND METHOD FOR MANUFACTURING SPROCKET SEGMENT

(75) Inventors: Bum Je Cho, Gyeongnam-Do (KR); Young Jin Jegal, Gyeongnam-Do (KR)

(73) Assignee: Daechang Forging Co., Ltd. (KR)

( * ) Notice: Subject to any disclaimer, the term of this patent is extended or adjusted under 35 U.S.C. 154(b) by 0 days.

(21) Appl. No.: 12/493,099

(22) Filed: Jun. 26, 2009

(65) Prior Publication Data

US 2009/0260410 A1 Oct. 22, 2009

Related U.S. Application Data

(63) Continuation of application No. PCT/KR2007/002239, filed on May 7, 2007.

(30) Foreign Application Priority Data

Jan. 5, 2007 (KR) ..... 10-2007-0001540

(51) Int. Cl.
*B21D 22/00* (2006.01)

(52) U.S. Cl. ..... 72/356; 72/353.2

(58) Field of Classification Search ..... 72/327, 72/328, 344, 352, 353.2, 356, 360; 29/893.34
See application file for complete search history.

(56) References Cited

U.S. PATENT DOCUMENTS 3,478,560 A * 11/1969 O'Brien ..... 72/257
4,207,762 A * 6/1980 Kelly, Jr. ..... 72/360
4,420,962 A * 12/1983 Peterson ..... 72/360
4,463,590 A * 8/1984 Theobald ..... 72/355.4
4,517,819 A * 5/1985 Sandroni ..... 72/327

* cited by examiner

*Primary Examiner*—Edward Tolan
(74) *Attorney, Agent, or Firm*—Park & Associates IP Law LLC

(57) ABSTRACT

Disclosed therein are an apparatus and method for manufacturing a sprocket segment, which can manufacture the sprocket segment through a simplified process including hot precision forging, through hardening and painting, thereby reducing manufacturing period and cost and securing competitive power. The sprocket segment manufacturing method includes: a primary hot forging process of putting a heated billet in a booster die (10) mounted on a forging press to perform a distribution of volume; a secondary hot forging process of putting the hot forged material (M) in a blocker die (11) to form a rib face (4); a tertiary hot forging process of putting the secondarily hot forged material (M) in a finisher die (12) to keep right angles and planes of a toothed face (6) and the rib face (4); and a process of putting the tertiarily hot forged material (M) in a product guide die (22) of a trimming-piercing-coining die (13) to eliminate a flash and form bolt holes (7) simultaneously.

2 Claims, 10 Drawing Sheets

APPARATUS AND METHOD FOR MANUFACTURING SPROCKET SEGMENT

REFERENCE TO RELATED APPLICATIONS

This a continuation of pending International Patent Application PCT/KR2007/002239 filed on May 7, 2007, which designates the United States and claims priority of Korean Patent Applications No. 10-2007-0001540 filed on Jan. 5, 2007, the entire contents of which are incorporated herein by reference.

FIELD OF THE INVENTION

The present invention relates to an apparatus and method for manufacturing a sprocket segment, and more particularly, to an apparatus and method for manufacturing a sprocket segment, which can manufacture the sprocket segment for driving or interlocking a track chain of a lower driving device of an endless track vehicle (a bulldozer, an excavator, etc.) through a simplified process including hot precision forging (press forging and precision trimming), through hardening and painting, thereby reducing a manufacturing period and a manufacturing cost and securing competitive power.

BACKGROUND OF THE INVENTION

In general, as shown in FIGS. 1 to 3, a plurality of sprocket segments 1 used in an endless track vehicle are manufactured separately, and consecutively mounted on a sprocket rim 2 via bolts 3, and in this instance, a rim assembly face, namely, a rib face 4 and a chain-driving face, which is in contact with a track chain 5, namely, a toothed face 6 must secure a plane.

In a forging process (hammer forging and general trimming process) according to a prior art, since an extraction slope for extracting a product is needed, after forging and through hardening processes, slop portions of the rib face 4 and the toothed face 6 are eliminated by means of machining, and bolt holes 7 coupled to the sprocket rim 2 are formed by means of drilling additionally performed. So, the forging process according to the prior art has several problems in that a manufacturing process takes much time and a manufacturing cost is expensive to thereby deteriorate productivity, require a considerable human power, and drop competitive power in price.

SUMMARY OF THE INVENTION

Accordingly, it is an object of the present invention to provide an apparatus and method for manufacturing a sprocket segment, which can secure planes of a rib face and a toothed face by turning a direction of a forging process at 90° and keeping an extraction slope of the toothed face within a range of 0° to 0.5°, and which can form bolt holes at the same time with an elimination of a flash during a trimming process without machining to the whole area of the segment, thereby saving the cost and quality.

To achieve the above objects, the present invention provides an apparatus for manufacturing a sprocket segment, which is installed on a press to manufacture the sprocket segment by means of a hot forging process, comprising: a bending type booster die having an upper die and a lower die for primarily hot-forging a heated billet in a booster type to distribute its volume; a blocker die having an upper die (16) and a lower die for secondarily hot-forging the material hot-forged in the booster die to form a rib face; a finisher die having an upper die and a lower die for tertiarily hot-forging the material hot-forged in the blocker die to keep right angles and planes of a toothed face and the rib face; knock-out pins mounted on the upper dies and the lower dies of the blocker die and the finisher die and elastically mounted on springs for extracting a product; a trimming-piercing-coining die for simultaneously trimming, piercing and coining the material hot-forged three times; a product guide die fixed on the upper portion of a lower trimming holder of the trimming-piercing-coining die, on which the material is seated; a flash cutting die mounted on an upper trimming holder located above the product guide die; a piercing punch vertically mounted on a cushion stripper; and a flash eliminating die mounted in both side directions of the product guide die for eliminating a flash cut by an operation of an air cylinder.

In another aspect of the present invention, the present invention provides a method for manufacturing a sprocket segment by performing a hot forging and a precision trimming on a forging press, the method comprising: a primary hot forging process of putting a heated billet between an upper die and a lower die of a bending type booster die to distribute a volume; a secondary hot forging process of putting the primarily hot forged material between an upper die and a lower die of a blocker die to form a rib face; a tertiary hot forging process of putting the secondarily hot forged material between an upper die and a lower die of a finisher die to keep a right angle and a plane of a toothed face and the rib face; and a process of putting the tertiarily hot forged material on a product guide die of a trimming-piercing-coining die and eliminating a flash and piercing bolt holes by a flash cutting die and a piercing punch vertically mounted on a cushion stripper.

The present invention can manufacture a sprocket segment for driving or interlocking a track chain through a simplified process of hot precision forging (press forging and precision trimming)→through hardening→painting, thereby reducing a manufacturing period and a manufacturing cost and securing competitive power.

In addition, the present invention can secure planes of a rib face and a toothed face by turning a direction of a forging process at 90° and keeping an extraction slope of the toothed face within a range of 0° to 0.5°, and form bolt holes at the same time with an elimination of a flash during a trimming process without machining to the whole area of the segment, thereby saving the cost and quality.

DETAILED DESCRIPTION OF THE INVENTION

Reference will be now made in detail to the preferred embodiment of the present invention with reference to the attached drawings.

Figure 1:
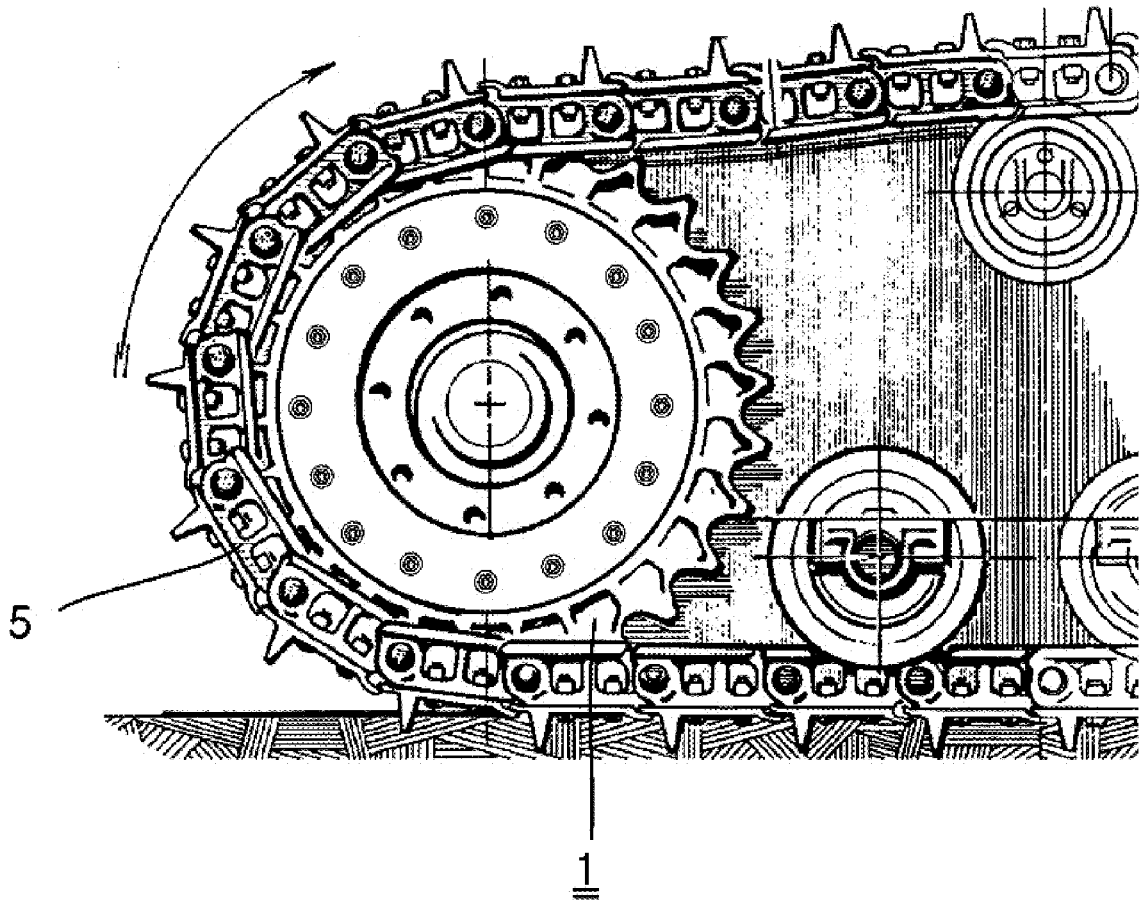
FIG. 1 is a front view of an endless track vehicle using a sprocket segment according to a prior art.
Figure 2:
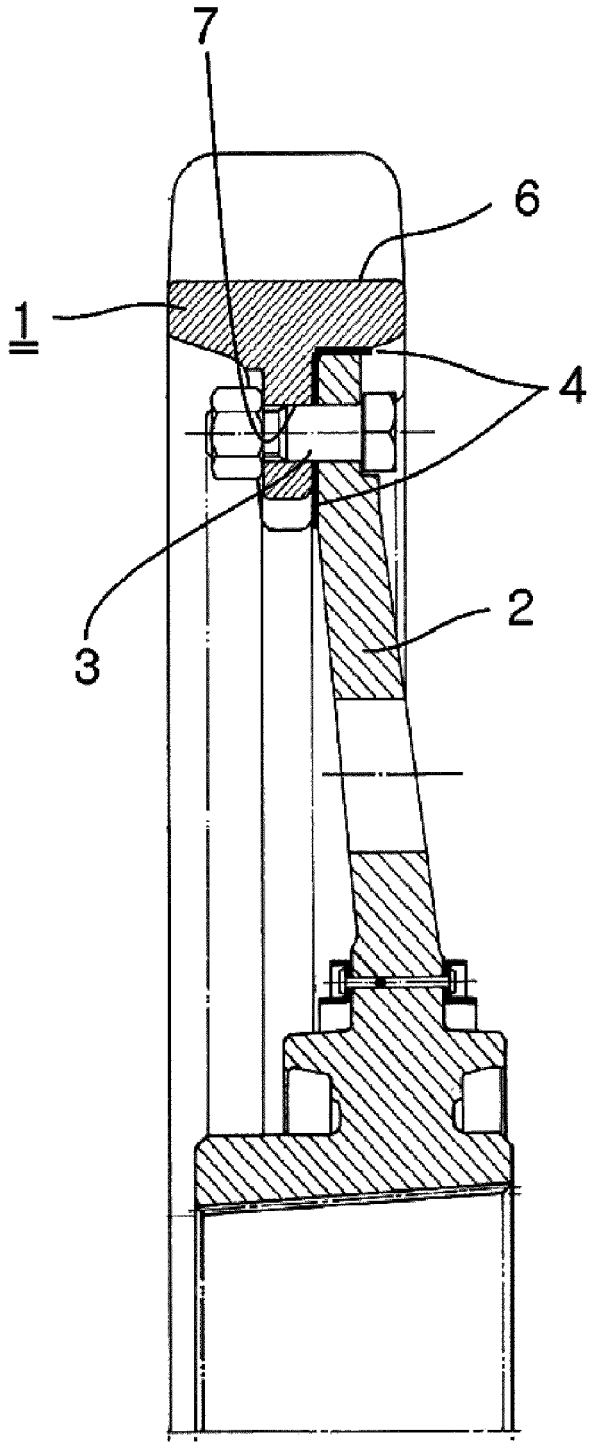
FIG. 2 is a vertically sectional view of a sprocket assembly using the sprocket segment.
Figure 3:
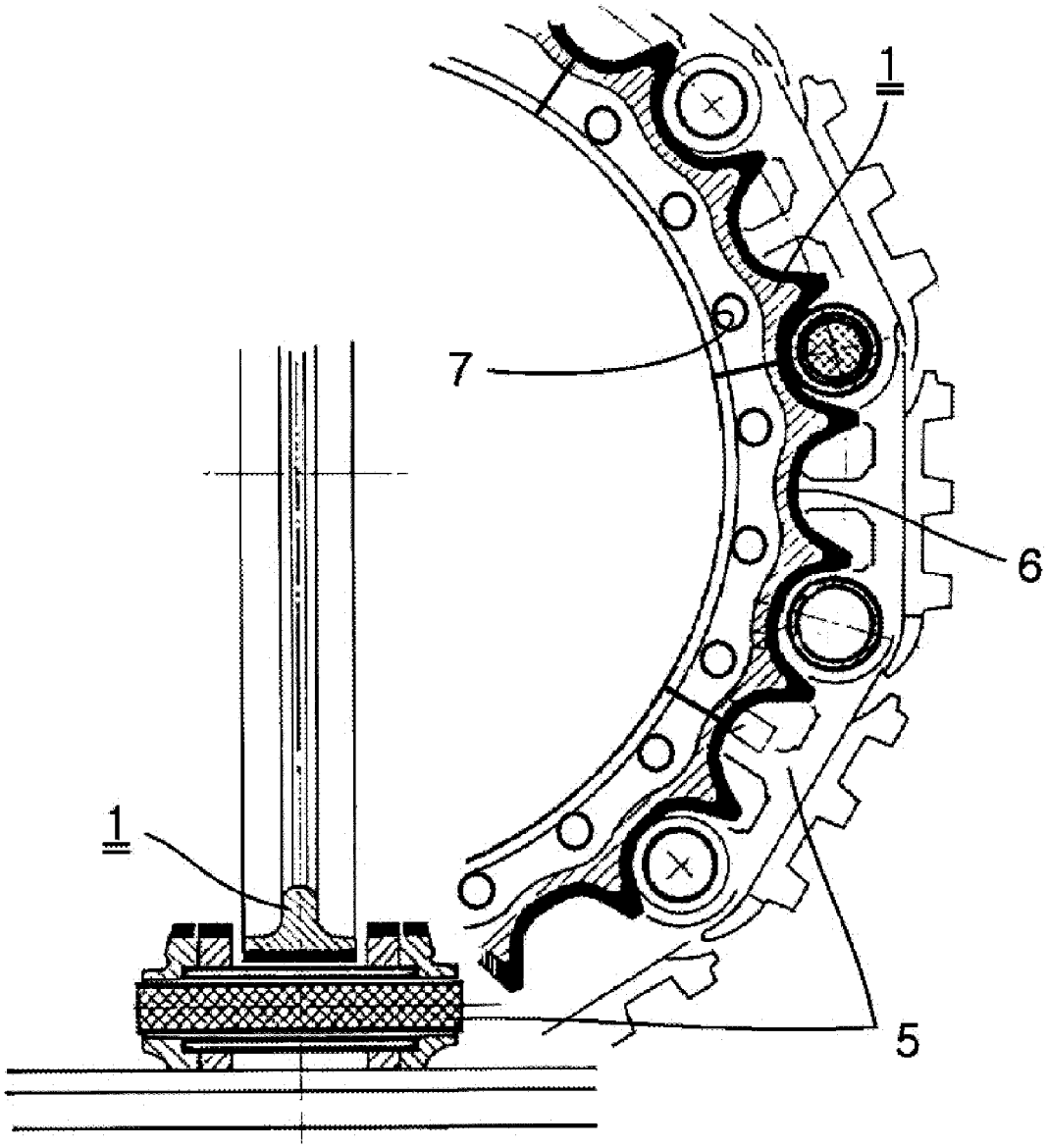
FIG. 3 is a front view and a sectional view for explaining a method for driving a track chain using the sprocket segment.
Figure 4:
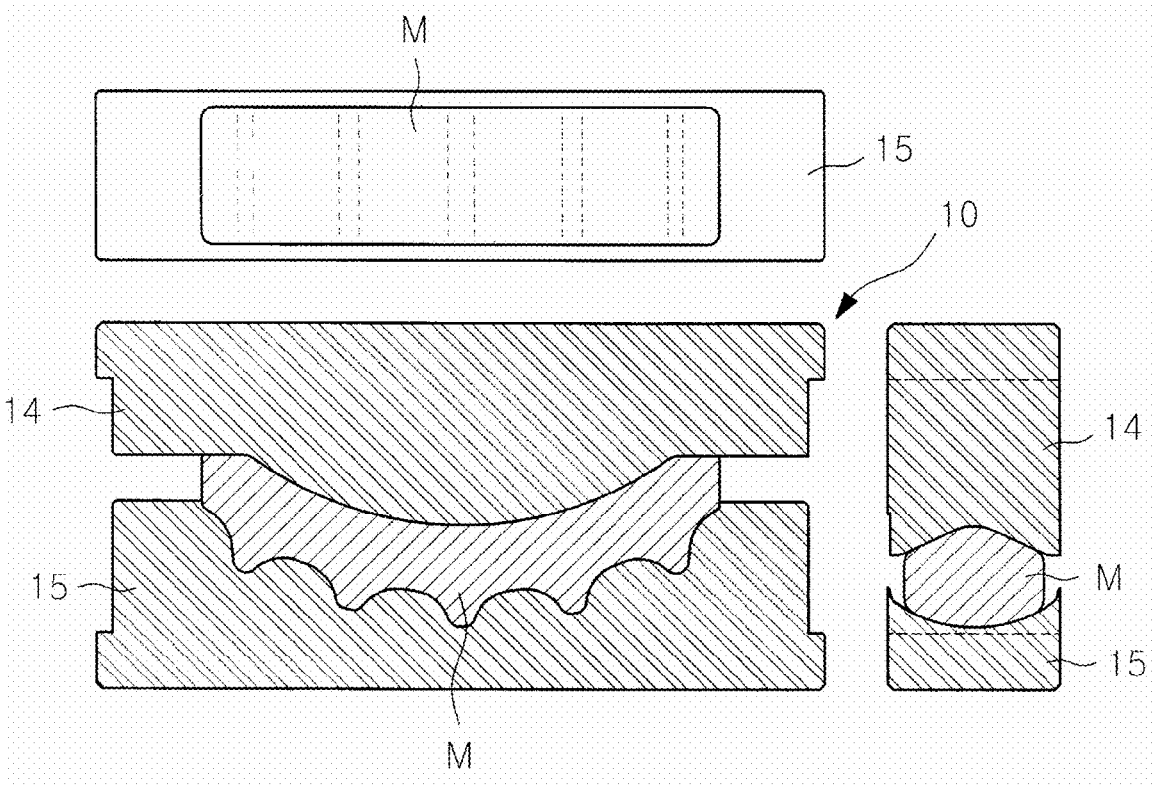
FIG. 4 is a plan view, a sectional view and a side sectional view showing a booster die of an apparatus for manufacturing a sprocket segment according to the present invention.
Figure 5:
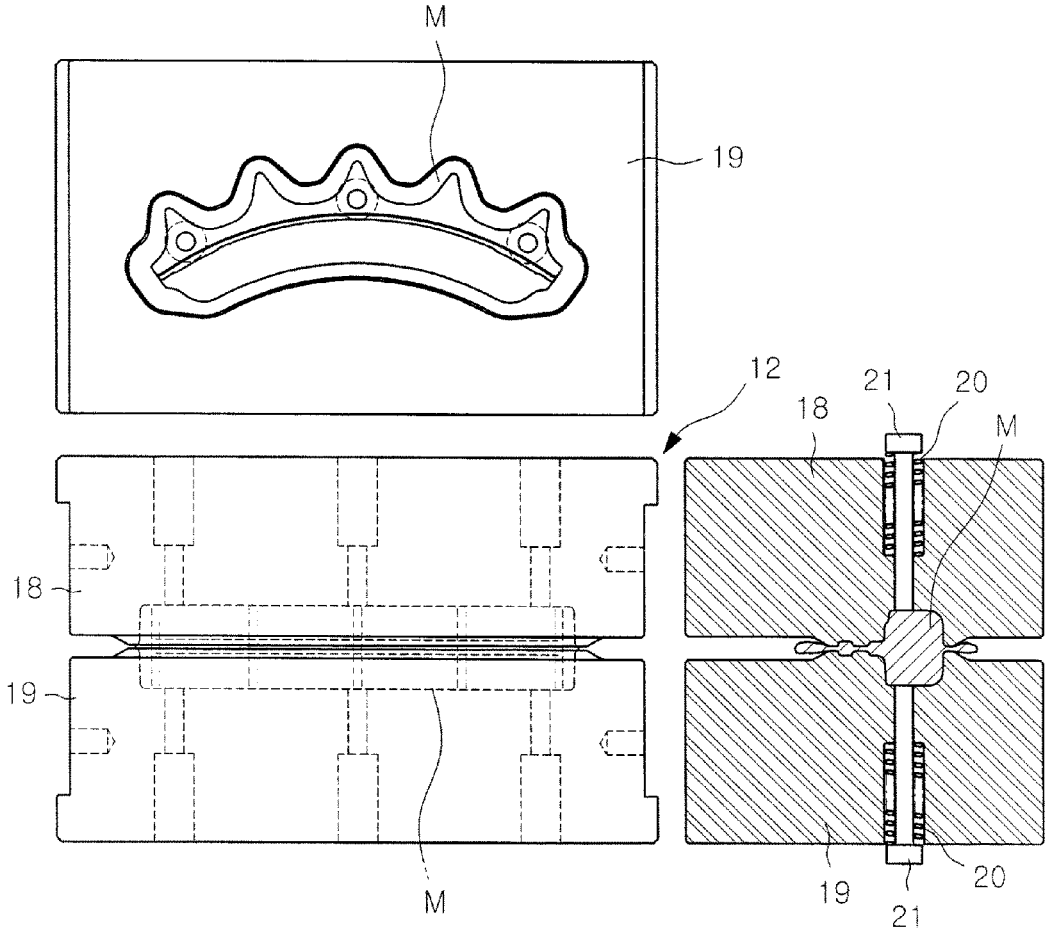
FIG. 5 is a plan view, a sectional view and a side sectional view showing a blocker die of the apparatus for manufacturing the sprocket segment according to the present invention.
Figure 6:
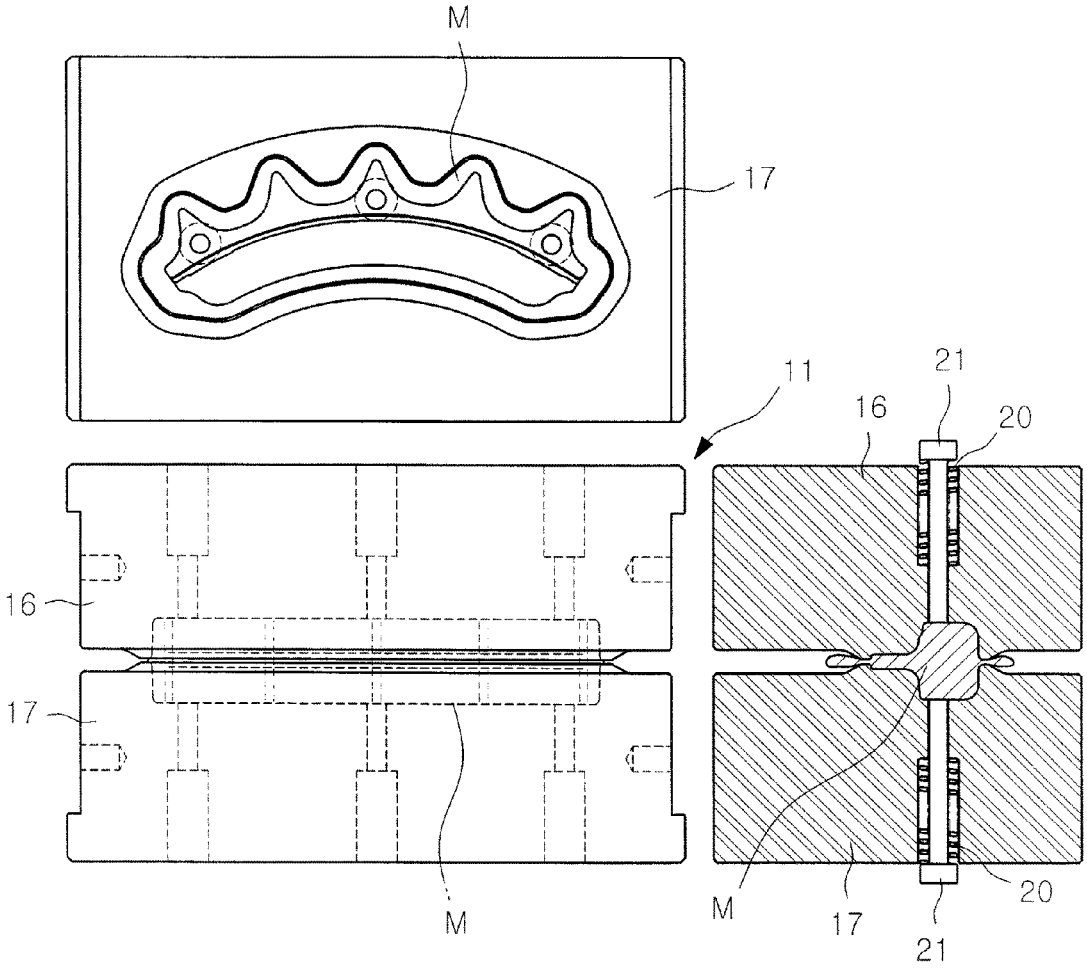
FIG. 6 is a plan view, a sectional view and a side sectional view showing a finisher die of the apparatus for manufacturing the sprocket segment according to the present invention.
Figure 7:
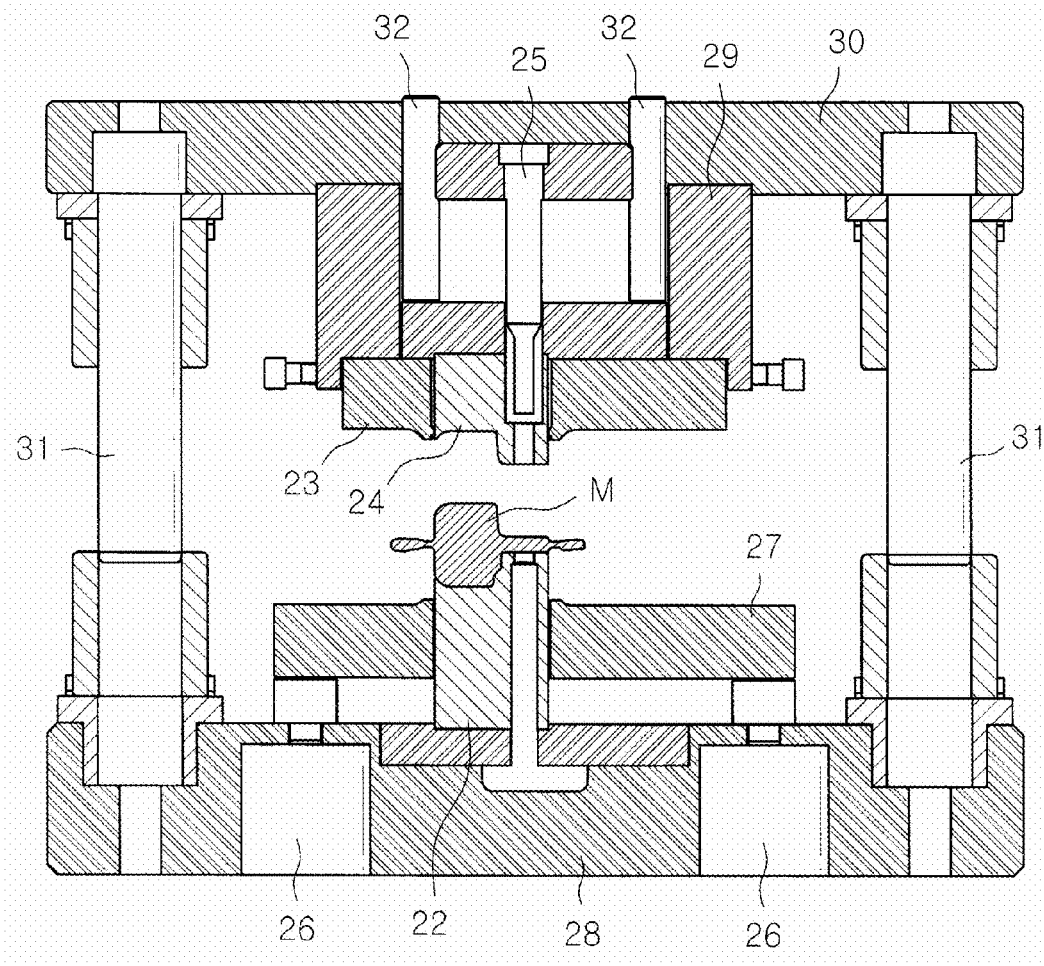
FIGS. 7 to 9 are sectional views showing operational processes and configurations of a trimming die, a piercing die and a coining die of the manufacturing apparatus in order.
Figure 8:
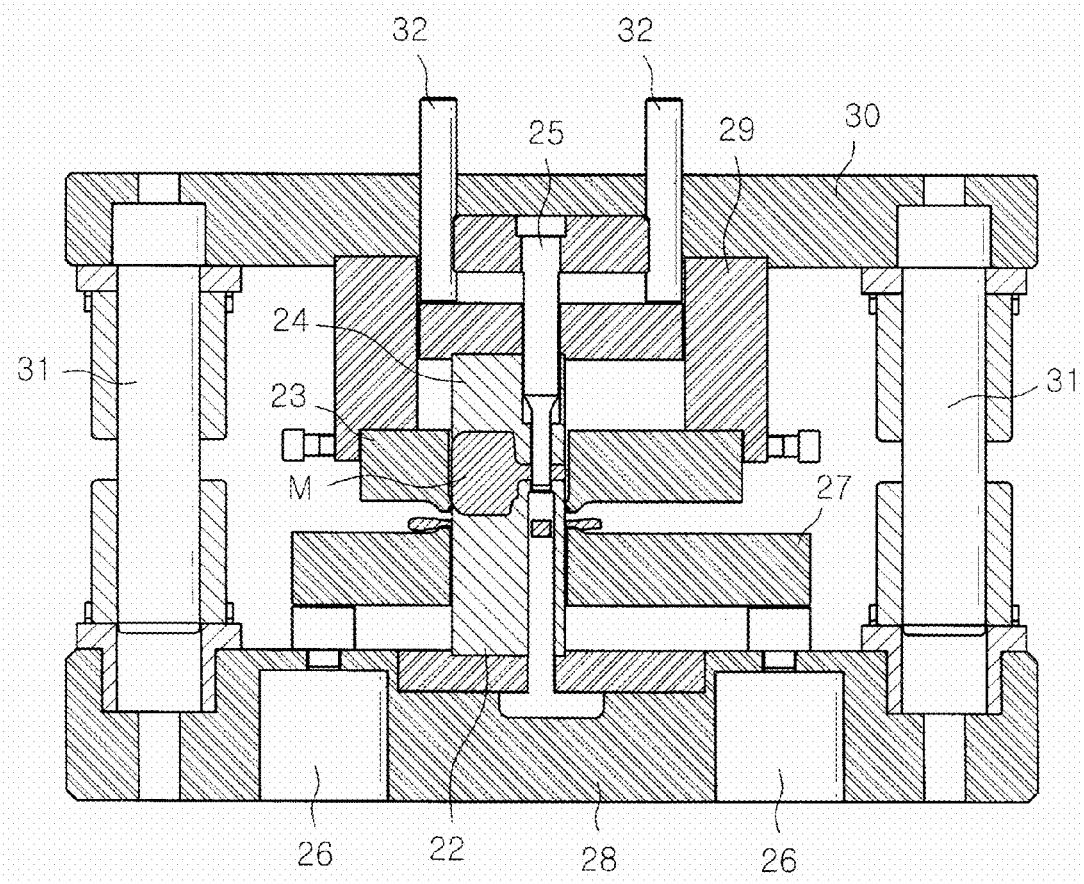
Figure 9:
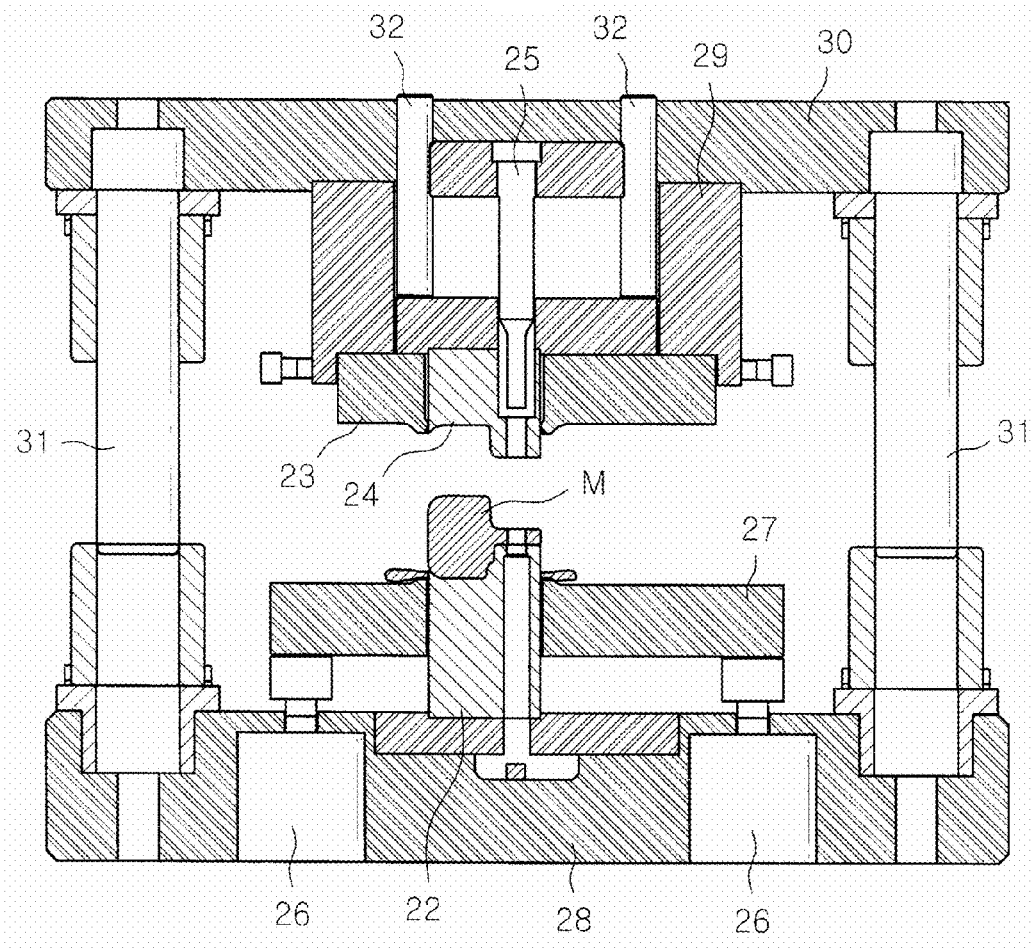

FIG. 4 is a plan view, a sectional view and a side sectional view illustrating a booster die 10 of a sprocket segment manufacturing apparatus according to the present invention, FIG. 5 is a plan view, a sectional view and a side sectional view illustrating a blocker die 11, FIG. 6 is a plan view, a sectional view and a side sectional view illustrating a finisher die 12, and FIGS. 7 to 9 are sectional views showing operational processes and configurations of a trimming die, a piercing die and a coining die of the manufacturing apparatus in order.

In the present invention, the same parts as the prior art are designated by the same reference numerals as the prior art.

The present invention can manufacture a sprocket segment 1 by sequential hot forging processes without machining, and in the present invention, four dies are used.

First, as the primary hot forging process, a heated billet is inserted between an upper die 14 and a lower die 15 of a bending type booster die 10, and hot-forged to thereby perform a distribution of volume. As the secondary hot forging process, a material (M) bent in the booster die 10 is conveyed to a blocker die 11 and hot-forged between an upper die 16 and a lower die 17 of the blocker die 11 to thereby form a rib face 4 of the sprocket segment 1.

After that, as a finisher process which is the tertiary hot forging process, the material (M) hot-forged in the booster die 10 and the blocker die 11 is put into a finisher die 12, and hot-forged between an upper die 18 and a lower die 19 in a state where a toothed face 6 and the rib face 4 keep a right angle and a plane. The upper dies 16 and 18 and the lower dies 17 and 19 of the blocker die 11 and the finisher die 12 respectively have knock-out pins 21 elastically mounted on springs 20 so that a product is automatically extracted when the dies 11 and 12 are opened.

The material (M) hot-forged three times is finally put and seated on a product guide die 22 of a trimming-piercing-coining die 13. When a press is operated, a piercing punch 25 vertically mounted on a cushion stripper 24 mounted at the center of a flash cutting die 23 of the upper part lowers, and so, the bolt holes 7 are formed.

In this instance, a flash formed at an end of the material (M) is cut from the material (M) simultaneously with a drop of the flash cutting die 23, the cut flash drops to a flash eliminating die 27 connected with an air cylinder 26, and automatically extracted according to an expansion and contraction motion of the air cylinder 26.

Moreover, the pierced flash, which is generated when the bolt holes 7 are formed, drops to a lower trimming holder 28, and automatically eliminated by air supplied to an air nozzle (not shown).

In the drawings, the reference numeral 29 designates a trimming die support, 30 designates an upper trimming holder, 31 designates a guider, and 32 designates K.D pins.

Hereinafter, a process for manufacturing the sprocket segment 1 using the sprocket segment manufacturing apparatus according to the present invention and an operation of each die will be described in detail.

First, the booster die 10, the blocker die 11 and the finisher die 12 are mounted on a bolster of the forging press in such a way as to carry out operations in order. After that, an operator puts the heated billet of about 1,250° C. between the upper die 14 and the lower die 15 of the booster die 10 and operates the forging press. Then, the upper die 14 lowers, and so, as shown in FIG. 4, the material (M) is hot-forged in the bending type.

When the primary hot-forging is finished by the booster die 10, the upper die 14 rises. After that, the operator puts the material (M) on the blocker die 11 shown in FIG. 5, and operates the forging press to perform hot-forging to the material (M) in a blocker type.

When the secondary hot-forging is finished, the operator puts the material (M) on the finisher die 12 shown in FIG. 6, and carries out the hot-forging, whereby a finished forged sprocket segment product is shaped.

Meanwhile, to secure roughness of the toothed faces 6 during forging in the blocker die 11, the toothed faces 6 of the upper die 18 and the lower die 19 do not have extraction slopes, and the forged product shaped in the blocker die 11 and the finisher die 12 is automatically extracted by the knock-out pins 21 elastically mounted on the springs 20.

The product finished by the finisher die is seated on the product guide die 27 of the trimming-piercing-coining die 13 shown in FIGS. 7 to 9. When a trimming press is operated, the flash formed on an edge of the product is cut by the flash cutting die 23, and at the same time, the bolt holes 7 are formed by means of a lowering motion of the piercing punch 25.

The product guide die 27 of the trimming-piercing-coining die 13 serves to seat the forged product on an exact position, the cushion stripper 24 serves to fix and coin the product with pressure received through the K.D pins 32, and the flash eliminating die 27 serves to automatically eliminate the flash, which was eliminated and dropped during the trimming step, by the operation of the air cylinder 26.

Figure 10:
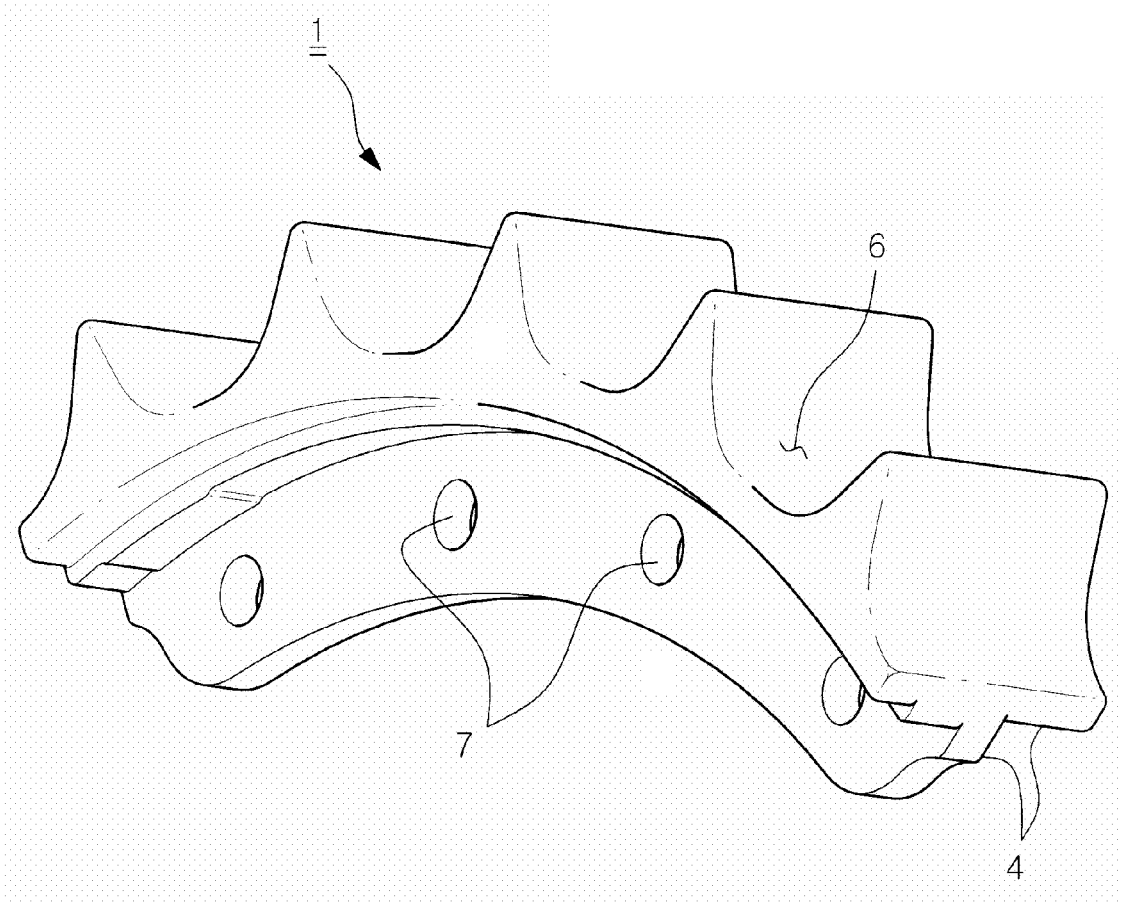
FIG. 10 is a perspective view of the sprocket segment manufactured by the manufacturing apparatus and a manufacturing method according to the present invention.

The sprocket segment 1 is completed in a shape of a finished product shown in FIG. 10 through the above process. The completed product has the toothed face 6, a rim mounting portion and the bolt holes 7 finished in such a way as to be properly mounted and used, and becomes the finished product through a through hardening process and a painting process, which are the final processes. After that, the finished product is mounted and used on a track chain of an endless track vehicle.

INDUSTRIAL APPLICABILITY

As described above, according to the present invention, the sprocket segment for driving or interlocking the track chain can be manufactured through the simplified process including hot precision forging (press forging and precision trimming), through hardening and painting, the apparatus and method for manufacturing the sprocket segment can reduce a manufacturing period and a manufacturing cost to thereby secure competitive power. Especially, since a direction of the forging process is turned at 90° and the extraction slope of the toothed face 6 is kept within a range of 0° to 0.5° to thereby secure the planes of the rib face 4 and the toothed face and the bolt holes 7 are formed at the same time with the elimination of the flash during the trimming process, machining to the whole area of the segment can be omitted, and so, the apparatus and method for manufacturing the sprocket segment according to the present invention can save the cost and improve quality.

What is claimed is:

1. An apparatus for manufacturing a sprocket segment, which is installed on a press to manufacture the sprocket segment (1) by means of a hot forging process, comprising:

a bending type booster die (10) having an upper die (14) and a lower die (15) for primarily hot-forging a heated billet in a booster type to distribute its volume;

a blocker die (11) having an upper die (16) and a lower die (17) for secondarily hot-forging the material (M) hot-forged in the booster die (10) to form a rib face (4);

a finisher die (12) having an upper die (18) and a lower die (19) for tertiarily hot-forging the material (M) primarily and secondarily hot-forged in the blocker die (11) to keep right angles and planes of a toothed face (6) and the rib face (4);

knock-out pins (21) mounted on the upper dies (16; 18) and the lower dies (17; 19) of the blocker die (11) and the finisher die (12) and elastically mounted on springs (20) for extracting a product;

a trimming-piercing-coining die (13) for simultaneously trimming, piercing and coining the material (M) hot-forged three times;

a product guide die (22) fixed on the upper portion of a lower trimming holder (28) of the trimming-piercing-coining die (13), on which the material (M) is seated;

a flash cutting die (23) mounted on an upper trimming holder (30) located above the product guide die (22);

a piercing punch (25) vertically mounted on a cushion stripper (24); and a flash eliminating die (27) mounted in both side directions of the product guide die (22) for eliminating a flash cut by an operation of an air cylinder (26).

2. A method for manufacturing a sprocket segment (1) by performing a hot forging and a precision trimming on a forging press, the method comprising:

a primary hot forging process of putting a heated billet between an upper die (14) and a lower die (15) of a bending type booster die (10) to distribute a volume;

a secondary hot forging process of putting the primarily hot forged material (M) between an upper die (16) and a lower die (17) of a blocker die (11) to form a rib face (4);

a third hot forging process of putting the secondarily hot forged material (M) between an upper die (18) and a lower die (19) of a finisher die (12) to keep a right angle and a plane of a toothed face (6) and the rib face (4); and a process of putting the tertiarily hot forged material (M) on a product guide die (22) of a trimming-piercing-coining die (13) and eliminating a flash and piercing bolt holes (7) by a flash cutting die (23) and a piercing punch (25) vertically mounted on a cushion stripper (24).

* * * * *